United States Patent [19]

Landheer

[11] Patent Number: 5,001,883

[45] Date of Patent: Mar. 26, 1991

[54] SANDWICH PANEL FOR CEILING APPLICATION

[75] Inventor: Hugo A. J. Landheer, Spijkenisse, Netherlands

[73] Assignee: Hunter Douglas International N.V., Curacao, Netherlands Antilles

[21] Appl. No.: 407,399

[22] Filed: Sep. 14, 1989

[30] Foreign Application Priority Data

Sep. 29, 1988 [NL] Netherlands ..... 8802386
Nov. 28, 1988 [NL] Netherlands ..... 8802915

[51] Int. Cl.[5] ..... E04C 2/34

[52] U.S. Cl. ..... 52/809; 52/484; 52/510

[58] Field of Search ..... 52/806, 809, 404, 510, 52/768, 488

[56] References Cited

U.S. PATENT DOCUMENTS

| | | | |
|---|---|---|---|
| 1,654,094 | 12/1927 | Riek | 52/809 |
| 2,926,237 | 2/1960 | Sorenson | 52/484 |
| 3,067,323 | 12/1962 | Kember | 52/484 |
| 3,110,370 | 11/1963 | Wulf, Jr. et al. | 52/809 |
| 3,267,626 | 8/1966 | Daly | 52/809 |
| 3,877,190 | 4/1975 | Corcoran, Jr. | 52/484 |
| 3,998,023 | 12/1976 | Anderson | 52/809 |
| 4,297,822 | 11/1981 | Rijnders | 52/484 |
| 4,344,267 | 8/1982 | Sukolics | 52/510 |
| 4,428,454 | 1/1984 | Capaul et al. | 52/484 |
| 4,773,200 | 9/1988 | Young | 52/484 |

*Primary Examiner*—David A. Scherbel
*Assistant Examiner*—Creigton H. Smith
*Attorney, Agent, or Firm*—Pennie & Edmonds

[57] ABSTRACT

Polygonal panel for a wall or ceiling cladding of the type in which certain longitudinal edges of the panels rest on supporting devices or are wedged in by the latter. The panel has a metal front plate, a metal rear plate and a core joined thereto, e.g. by adhesive, composed preferably of lightweight, e.g. fibre, material having non-flammable or fire-retarding and/or sound absorbing properties. The front plate is formed with at least two longitudinal side flanges which are bent over or turned over towards the rear of the panel, at least partly to enclose the core at at least two longitudinal sides. The flanges are provided with adjoining free edge parts being over or turned over outwards at an angle. The free edge portions are completely overlapped by edge parts of the rear plate which extend beyond the core, the thickness of the core and the form and shape of the longitudinal edges and the edge portions being matched to each other in a manner such that no direct contact exists between rear plate and front plate.

14 Claims, 3 Drawing Sheets

FIG. 6
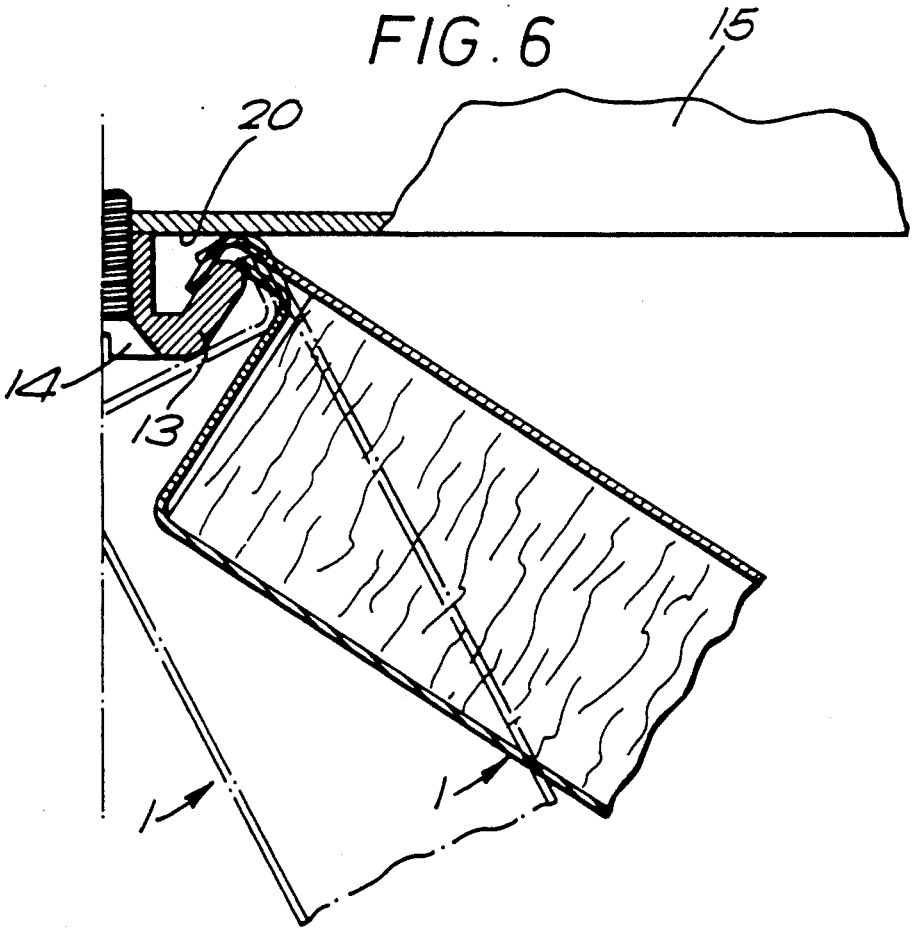
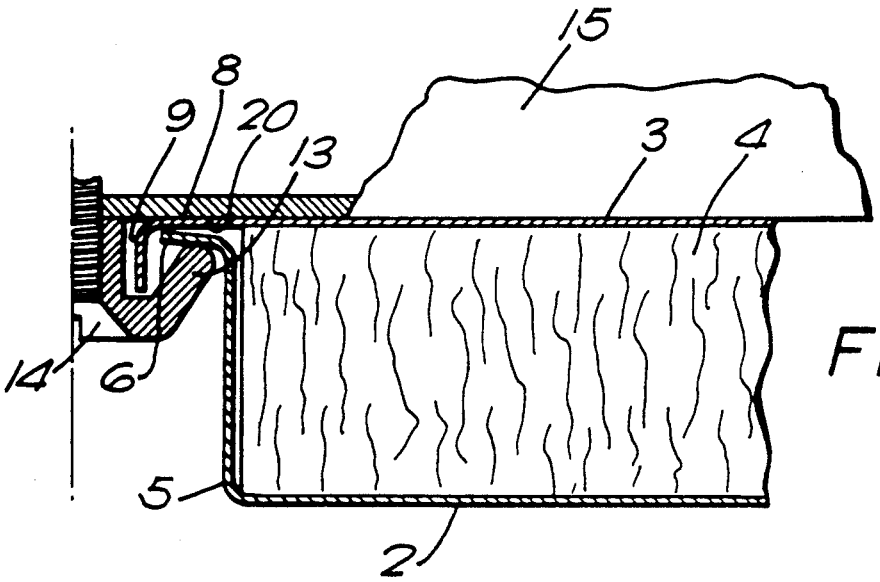
FIG. 7

SANDWICH PANEL FOR CEILING APPLICATION

The invention relates to a polygonal (rectangular, trapezoidal, triangular, etc.) panel for a wall or ceiling cladding of the sandwich type, in which certain longitudinal edges of panels rest on supporting devices or are wedged in by the latter, which panel has a metal front plate, a metal rear plate and a core, joined thereto, composed preferably of lightweight material having nonflammable or fire-retarding and/or sound-absorbing properties. Such structures are used as ceiling or exterior members for applications which require particular acoustic, thermal or fire-resistance properties.

The object of the invention is to improve the structure of such panels in a manner such that, in particular, the mechanical properties which can be achieved with such sandwich structures and which determine the self-supporting nature and usability of the panel, such as high strength and rigidity coupled with a low weight, can be utilized better.

For this purpose, the panel is characterized, according to the invention, in that the front plate is formed with at least two longitudinal side flanges which are bent over or turned over towards the rear of the panel, partly to enclose the core at least two longitudinal sides and which are provided with adjoining, free edge portions bent over or turned over outwards at an angle to the side flanges, said free edge parts being completely overlapped by edge parts of the rear plate which project laterally beyond the core, the thickness of the core and the form and the shape of the longitudinal side flanges and the edge portions and edge parts being matched to each other in a manner such that no direct contact exists between rear plate and front plate.

This measure utilizes the full panel height to increase the resistance of the front panel to sagging, while a supporting edge is also produced by means of which the panel can be mounted along its entire length. The overlapping of the edge parts and portions makes it possible to achieve a rigid wedging-in of the front and rear plates in a particular manner of mounting the panels.

This measure further makes it possible to clamp the front and rear plates with the core in between during manufacture in a manner such that the core is temporarily deformed elastically without at the same time running the risk that the overlapping edge parts and portions deform. In the finished product, this spacing offers the possibility of wedging in the overlapping edge parts with elastic deformation when mounting the panel, as a result of which a rattle-free mounting is obtained.

The respective projecting edge parts of the rear plate may continue past the respective free edge portions, of the front plate and are formed as longitudinal rims which are turned over towards the front and which enclose the two free edge portions of the front plate. This measure gives the rear plate a certain rigidity during manufacture, at the same time simplifies the positioning on the front plate and imparts to the finished product the possibility of transmitting tensile loadings in the rear plate to the mounting means. This latter may play an important role in fire situations or in the case of wind gusts.

Advantageously the front plate has further flanges, turned over towards the rear, which, together with the longitudinal side flanges, at least partly enclose the core laterally on all sides. This not only simplifies the fitting of the core during manufacture but also makes it possible to mount the panel ends visibly without the core at the same time becoming visible. A panel according to the invention has, however, per se a strength and rigidity which makes it readily possible to cut off the panel to a required length, under which circumstances the end wall of the panel becomes "open", i.e. the core material visibly forms said end at the same time. This makes it possible to match in a simple manner to the dimensions of the room to be clad.

In order to increase the usability of the panel for diverse purposes, it is advisable to join the front plate and the rear plate to the core by means of a nonflammable or low-flammability bonding material. In cases where the panel according to the invention may be constructed from materials which do not catch fire in normal fire situations, the requirement may at least be imposed with respect to the bonding material that this material will also not have to cause any spread of the fire situation. If mineral wool or cores of other fibrous materials are used, the strength of the panel can be considerably increased by fitting the core material in a manner such that the main fibre direction is transverse to the front plate and rear plate. As a result of this, with a plate of aluminium approximately 0.7 mm thick on either side of a mineral wool core having a density of around and close to 150 kg/m$^3$ or higher, it is possible for example to obtain a self-supporting, relatively rigid panel up to 1.60 metres wide and 12 or more metres long.

In an advantageous method of achieving this, the mineral wool fibres are first bonded to each other in the form of plates, with the fibre direction essentially parallel to the main face of such a plate. By then dividing the mineral wool plate obtained in this manner into ribbons or strips, strips of bonded mineral wool fibres are produced which can each be oriented with their fibre direction essentially transverse (i.e. turned through 90°) to the skin plates.

It is particularly beneficial to assemble the core in this case from a plurality of strips of fibre material arranged next to each other and joined.

The invention also provides a method for manufacturing panels such as those described above. This method is characterized in that preformed front and rear plates provided at the inside with adhesive and an appropriate core are pressed together under a certain pressure and over a certain time in such a manner and are held in such a manner that no contact which prevents or limits bonding occurs between front plate and rear plate and at the same time, a maximum flattening of the bonding faces of the core and a very uniform bonding over the whole of the surfaces to be bonded take place. As a result of this, not only is an excellent adhesion obtained but also an optimum mounting of the cladding structure is achieved by a certain mutual spacing between the overlapping panel edge parts.

This mutual spacing may be in the order of magnitude of 1–3 mm.

The invention also relates to a demountable wall or ceiling structure comprising a plurality of panels according to the invention, panel installation parts and supporting devices, the supporting devices each having a web part for joining to an installation part and are each provided with at least one panel supporting part which is so formed and dimensioned that, in the mounted state of a panel, the spacing between the panel supporting part and the associated installation part is less than the mutual spacing between the outside faces of front panel edge portions and rear panel edge part but at least equal to the sum of the front and rear plate thicknesses, as a result of which each respective panel installation part and the respective panel supporting part are held in a clamping manner with elastic deformation of at least one of the edge part and edge portions. As a result of the wedging-in with elastic deformation of the panel edge part or portion, the position assumed is fixed and safeguarded against displacement. Noise-producing vibrations, such as those which could arise as a result, for example, of traffic, are also successfully combated by this wedging-in. This makes the ceiling extremely suitable for outside applications, such as, for example, petrol stations or railway stations, and underground railway stations.

The space between the arms (panel supporting parts) and the backs (panel installation parts) in which longitudinal side flanges can be received in each case is such that sufficient lateral play is available to make dimensional tolerances and thermal expansion of the panels and the supporting structure possible.

A preferred embodiment is characterized in that the panel supporting part is directed towards the same side as the web part and is constructed as a divergent arm in a manner such that the overlapping edge part and edge portion of a panel can be brought to the final position with respect to the supporting part by an insertion and tilting movement.

The installation parts may further form an entity and form part of the supporting part and be manufactured, for example, by extrusion and cutting off.

The panel supporting device may also be provided in parallel with a supporting part and thereby adapted to the function of an end supporting device adjacent to a limiting face or limiting wall. The substructure may possibly form an entity with the installation parts and the supporting parts, the web parts merging into the substructure. For this purpose, this entity may be formed from a separate support, for example, of sheet metal which is in turn fitted per se against a fixed substructure such as a fixed ceiling, wall or frame and attached thereto.

In order that the present invention may more readily be understood, the following description is given, merely by way of example, reference being made to the accompanying drawings in which:

FIG. 6 is a partial section of a mounted supporting device of FIG. 5, showing different panel positions during mounting.

FIG. 7 is a view similar to FIG. 6, but with the panel mounted.

Figure 1:
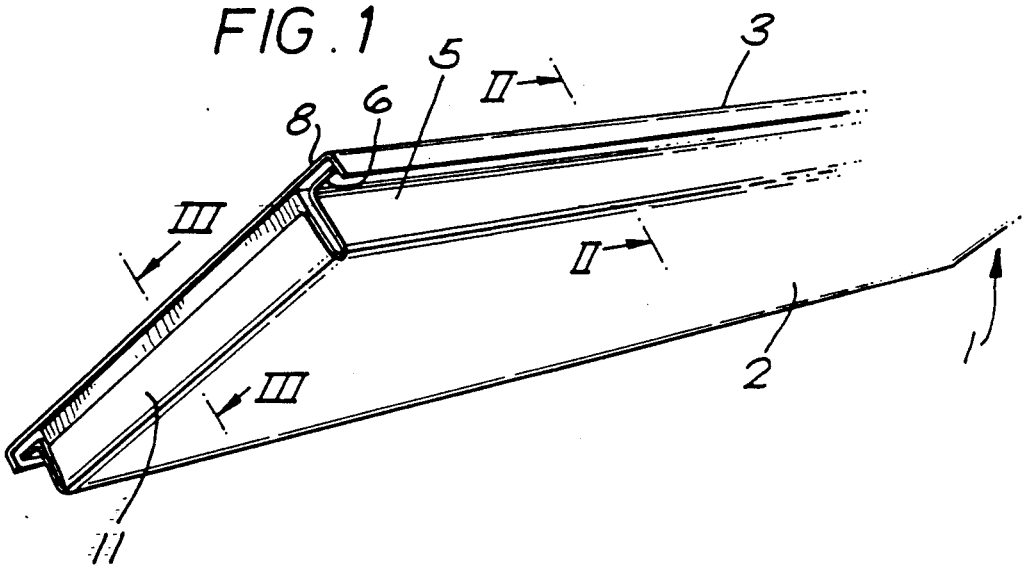
FIG. 1 is a perspective view of one embodiment of panel according to the invention.
Figure 2:
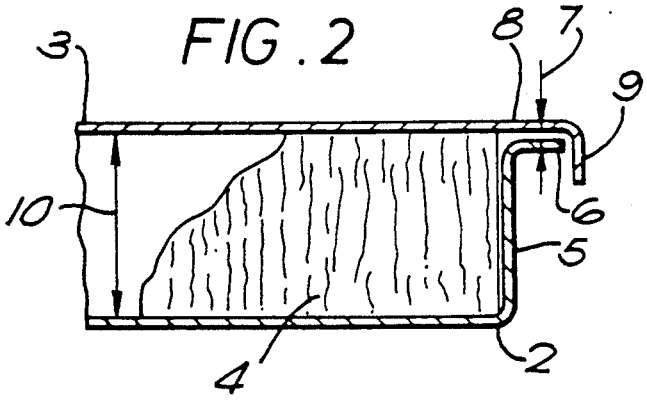
FIG. 2 is a partial section of the longitudinal edge of the panel taken along the line II—II in FIG. 1.

The panel indicated with reference numeral 1 in FIG. 1 is composed of a front plate 2 and a rear plate 3 which, as can be seen in FIG. 2, is held at a distance from the front plate by a core 4. Both the front plate and the rear plate are of metal, preferably lacquered aluminium. In the exemplary embodiment, mineral wool is used as core material, but a comparable result can also be obtained with other lightweight materials and/or structures.

As can be seen in FIG. 2, the front plate is provided with longitudinal side flanges 5 which are turned over towards the rear of the panel and which partly enclose the core 4 at two oppositely situated longitudinal sides. The side flanges 5 are each constructed with a free edge portions 6 turned outwards. This free edge part 6 is completely overlapped by an edge part 8 of the rear plate 3 projecting past the core, with a spacing 7 being maintained. The spacing 7 has a two-fold purpose and ensures, inter alia, during the manufacture that the assembly of the front and rear plates 2, 3 and core 4 can be pressed satisfactorily onto each other without running the risk of damaging the edge parts 6 and 8 of the front and rear plates or of being able to exert too little pressure as a result of too small a spacing. The spacing 7 also makes it possible to clamp the edge parts 6 and 8, which also serve to mount the panel on the wall or ceiling part to be clad, with prestressing and thus to obtain a rattle-free mounting.

In FIG. 2 it is furthermore evident how the edge part 8 of the rear plate 3 continues past the free edge portion 6 of the front plate 2 and is formed with a longitudinal rim 9 turned over towards the front side. The longitudinal rim 9 makes one and the same angle with the main face of the rear plate as an identically turned-over longitudinal edge at the oppositely situated edge part of the rear panel 3, and these rims run mutually parallel or approximately parallel. In this instance, the longitudinal rims 9 are at an angle of 90° with respect to the rear plate. For the purpose of adaptation to certain supporting structures, this angle may of course also be smaller or greater than 90°.

The spacing 7 is obtained by a suitable choice of the core thickness 10 with respect to the height of the side flange 5.

Figure 3:
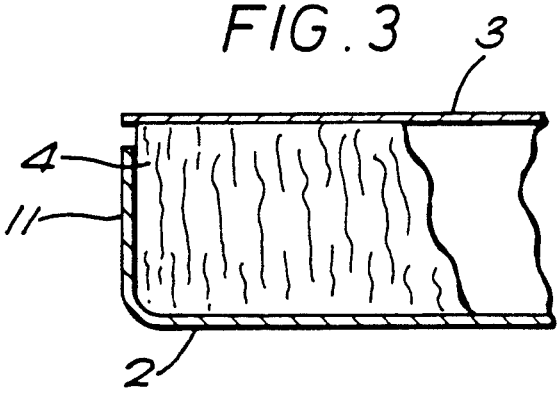
FIG. 3 is a partial section of the transverse edge of the panel taken along the line III—III in FIG. 1.

In FIGS. 1 and 3 it can further be seen that the other edges of the front plate, such as in this case the transverse edge, may also be turned over towards the rear of the panel to form an edge flange 11 in order at least partly to enclose the core 4 on all sides.

Figure 4:
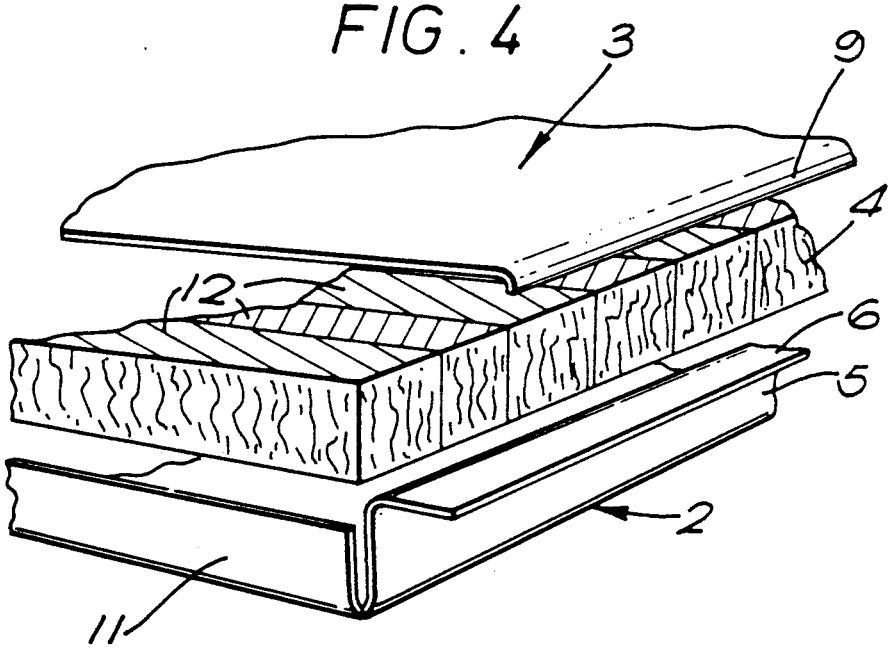
FIG. 4 is an exploded perspective view at of one of the corners of the panel.

To form the panel, the component parts are brought together as indicated in FIG. 4. The joint is brought about with the aid of glue with which the entire inside surface of both the front and the rear plate may be covered.

The bonding to the core 4 only comes about at those points where fibres of the core make contact with these layers of glue. As a result, the surface proportion of the bonding points is relatively small and varies depending on the type of core between 2 and 10% of the total surface jointly occupied.

The homogeneous structure of the core material and the consequently proportional distribution of the bonding points ensures a good mutual bond starting from a proportion of surface area of not less than 2% of the common surface area.

In order to achieve as great a strength as possible of the mineral wool core, care is taken to ensure that the fibre direction runs transversely to the panel while the fibres are pressed onto each other with a binder to obtain the necessary compactness. In manufacturing the panel according to the invention, the inside surface of a front plate 3 is provided with a suitable adhesive, after which strips of mineral wool 12 (see FIG. 4) are arranged on the inside surface. After having provided an appropriately prepared rear plate 3 with adhesive, the latter can be placed on the already fitted strips of mineral wool 12 and the assembly thus obtained can be held under pressure in a press to bring about the mutual glue joint during a time period appropriate for the glue concerned.

In this process, the pressure is so chosen that the core material is temporarily deformed elastically. All this takes place within the permissible limits of the core material and with the gap 7 between the edge parts of the skin plates being maintained. This produces a panel with an excellent uniform adhesion between core and plates and the large plate surfaces of relatively thin material with respect to their dimensions remain or become rigid and flat.

Figure 5:
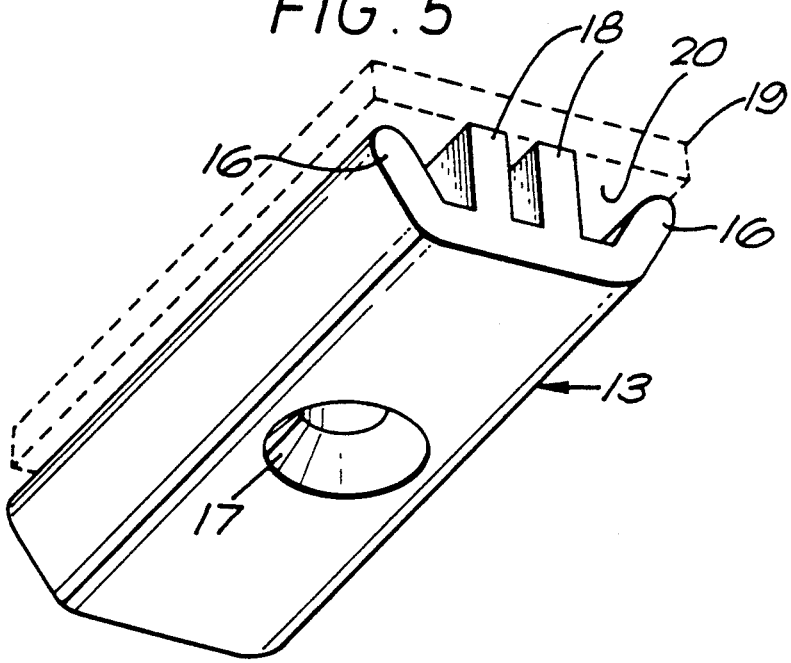
FIG. 5 is a perspective view of one embodiment of supporting device which may be used to interact with the longitudinal edges of the panel.

A particularly appropriately formed supporting device 13 is depicted in FIG. 5. In FIGS. 6 and 7 it can be seen how this supporting device 13 can be attached to a supporting beam 15 with the aid of a mounting device such as a screwed component 14. The supporting device itself is provided with a hole 17 in which a mounting device can be received, and with outwardly directly divergent arms 16 around which the respective edge parts 6 and 8 and longitudinal edges 9 can engage. For this purpose, it is necessary for the arms 16 to be held at a fixed distance from, for example, the undersurface forming part of the supporting beam 15, and this is achieved by upright ridges 18 which are separated from each other by a longitudinal gap.

FIG. 5 shows in broken lines the possibility of an upper part 19 which is integral with the supporting device 13 an shows an embodiment in which the upper part actually forms the installation part and it is consequently an alternative to a separate installation part or to an installation part forming part of the fixed substructure and can, in particular, offer an advantage in those situations where no regular mounting surface such as a supporting beam or something similar is available but, for example, only a frame.

The spacing produced by the upright ridges 18 between the arms 16 and the undersurface of the supporting beam or upper part 19 is such that a panel 1 can be hooked in, as shown in two positions in FIG. 6, and can be tilted towards the supporting beam 15 or mounting surface. During the rotation movement necessary for this, the panel edge part 6 is wedged in as shown in FIG. 7 with elastic prestressing if the dimensions of the supporting device 13 and of the panel edge parts 6 and 8 are correctly matched to each other. Subsequent to this, the opposite supporting edge of the panel is firmly screwed by means of the next supporting device and the next panel can then be mounted as described above.

The space between the arms 16 and the ridges 18 in which a turned-over longitudinal edge 9 can be received in each case is such that sufficient lateral play is available to make dimensional tolerances and thermal expansion of the panels and the supporting structure possible.

It is obvious that numerous possibilities are available to the person skilled in the art within the scope of the invention to deviate, in accordance with the intended object, from the embodiment described here as an example. As an illustration, reference is further made here to the possibility of giving the panels a bent or geniculate form deviating from the flat form and the possibility of, for example, providing the front plate with a perforation to improve the acoustic properties.

I claim:

1. A polygonal panel for a wall or ceiling cladding of the type in which certain longitudinal edges of the panels rest on or are wedged in by supporting devices, said panel comprising:

(a) a metal front plate;

(b) a metal rear plate;

(c) a core sandwiched between and secured to said front and rear plates;

(d) at least two longitudinal side flanges of said front plate bent over towards the rear of the panel, partly to enclose the core on at least two longitudinal sides thereof;

(e) free edge portions of said longitudinal side flanges bent outwardly at an angle to said side flanges, said free edge portions being deformable in the direction of the rear plate; and (f) edge parts of said rear plate completely overlapping said longitudinal side flanges and said free edge portions thereof; the thickness of said core and the shape and form of said front panel longitudinal side flanges, the edge portions thereof and of said rear panel edge parts being matched whereby no direct contact exists between said rear plate and said front plate.

2. A panel as claimed in claim 1, wherein said projecting edge parts of the rear plate extend beyond said free edge portions of said side flanges of the front plate and further comprising longitudinal rims formed on said projecting end parts and bent forwardly effective to enclose the free edge portions of the front plate.

3. A panel as claimed in claim 1, and further comprising end flanges bent rearwardly on at least some of the front panel edges, effective, together with the side flanges thereof, at least partly to enclose the core.

4. A panel as claimed in claim 1 and further comprising non-flammable or low-flammability bonding material joining said core to said front and rear plates.

5. A panel as claimed in claim 1, wherein said core is composed of fiber material which is bonded together and is fitted between said front and rear plates whereby the longitudinal direction of the fibers of said material is transverse to the planes of said front and rear plates.

6. A panel according to claim 5, wherein the core is composed of a plurality of strips of said fiber material joined together.

7. A polygonal panel according to claim 1 wherein the front plate free edge portions and rear plate edge parts define therebetween a spacing or approximately 1–3 mm.

8. A demountable wall or ceiling structure comprising:

(i) a plurality of panels, each panel comprising:

(a) a metal front plate;

(b) a metal rear plate;

(c) a core sandwiched between and secured to said front and rear plates;

(d) at least two longitudinal side flanges of said front plate bent over towards the rear of the panel, partly to enclose the core on at least two longitudinal sides thereof;

(e) free edge portions of said longitudinal side flanges bent outwardly at an angle to said side flanges; and (f) edge parts of said rear plate completely overlapping said longitudinal side flanges and said free edge portions thereof; the thickness of said core and the shape and form of said front panel longitudinal side flanges, the edge portions thereof and of said rear panel edge parts being matched whereby no direct contact exists between said rear plate and said front plate.

(ii) panel installation parts;

(iii) supporting devices mounted on said panel installation parts, said supporting devices each including:

(g) a web part joined to said installation part; and (h) at least one panel supporting part formed and dimensioned, in the mounted state of the associated panel, whereby the spacing between the panel supporting part and the associated installation part is less than the mutual spacing between the outside faces of the front panel edge portion and the rear part, but at least equal to the sum of the front and rear plate thicknesses, as a result of which each respective panel installation part and the respective panel supporting part are held in a clamping manner with elastic deformation of at least one of the edge part and the edge portion.

9. A wall or ceiling structure as claimed in claim 8, wherein the panel supporting part is directed towards the same side as the web part and is constructed as a divergent arm in a manner whereby the overlapping edge part and edge portion of a panel can be brought to the final position with respect to the supporting part by an insertion and tilting movement.

10. A wall or ceiling structure as claimed in claim 8, wherein the panel installation part forms part of the supporting device.

11. A wall or ceiling structure as claimed in claim 8, where each supporting device has two oppositely situated panel supporting parts.

12. A wall or ceiling structure as claimed in claim 8, wherein the panel installation part forms part of a substructure to which the supporting devices are joined.

13. A polygonal panel for a wall or ceiling cladding or the type in which certain longitudinal edges of the panels rest on or are wedged in by supporting devices, said panel having front and rear sides and comprising:

(a) a front plate having at least two longitudinal side flanges bent towards the rear of the panel, said side flanges having free edge portions bent outwardly at an angle to said side flanges;

(b) a rear plate having edge parts completely overlapping the longitudinal side flanges and free edge portions of the front plate; and (c) a homogeneous elastically deformable core sandwiched between the front and rear plates, said core having a thickness selected to space apart said plates with the front plate longitudinal free edge portions and rear plate edge parts defining an unobstructed spacing therebetween, whereby said longitudinal free edge portion may be deformed into said spacing.

14. The polygonal panel according to claim 13 wherein the spacing between the free edge portions and edge parts is approximately 1–3 mm.

* * * * *